United States Patent [19]

Wataya

[11] Patent Number: 4,702,214

[45] Date of Patent: Oct. 27, 1987

[54] FUEL INJECTION CONTROL SYSTEM FOR INTERNAL COMBUSTION ENGINE

[75] Inventor: Seiji Wataya, Hyogo, Japan

[73] Assignee: Mitsubishi Denki Kabushiki Kaisha, Tokyo, Japan

[21] Appl. No.: 914,402

[22] Filed: Oct. 2, 1986

[30] Foreign Application Priority Data

Oct. 2, 1985 [JP] Japan ..... 60-218139

[51] Int. Cl.[4] ..... F02D 41/18

[52] U.S. Cl. ..... 123/488; 123/486; 123/494; 73/118.2

[58] Field of Search ..... 123/488, 494, 486, 478; 73/118.2

[56] References Cited

U.S. PATENT DOCUMENTS 4,217,863 8/1980 Ezoe ..... 123/494

4,594,987 6/1986 Wataya et al. ..... 123/494

*Primary Examiner*—Andrew M. Dolinar

*Attorney, Agent, or Firm*—Sughrue, Mion, Zinn, Macpeak & Seas

[57] ABSTRACT

A fuel injector control apparatus wherein a total opening of a throttle valve and a bypass value are calculated in order to correct return blow through a flow sensor.

5 Claims, 8 Drawing Figures

FUEL INJECTION CONTROL SYSTEM FOR INTERNAL COMBUSTION ENGINE

BACKGROUND OF THE INVENTION

1. Field of the Invention

This invention relates to a fuel injection control apparatus for an internal combustion engine of a car, and particularly to such a control apparatus which processes measured values of the quantity of suction air in the internal combustion engine.

2. Background of the Invention

FIG. 1 illustrates a previously known fuel injection control apparatus for an internal combustion engine of the kind described above. Referring to FIG. 1, the numeral 1 designates an internal combustion engine. An electromagnetically driven injector (fuel injection valve) 2 supplies fuel to the internal combustion engine 1. A hot-wire air-flow sensor 3 detects the quantity of air sucked into the engine. A throttle valve 5 within a suction pipe 6 regulates the quantity of air sucked into the engine 1. A water temperature sensor 7 detects the temperature of the engine. A controller 8 computes the quantity of fuel to be supplied to the engine on the basis of an air quantity signal supplied from the air-flow sensor 3 and then applies a pulse having a width corresponding to the required fuel quantity to the injector 2. Further, an igniter 9 generates a pulse signal for the controller 8 at a predetermined rotational angle of the engine during each engine revolution. Also shown in FIG. 1 is a fuel tank 11. A fuel pump 12 applies pressure to the fuel in the tank 11. A fuel pressure regulator 13 maintains the fuel pressure to the injector 2 constant. Finally, there is shown an exhaust pipe 14. The controller 8 includes an input interface circuit 80, a microprocessor 81 and a ROM 82. The microprocessor 81 is arranged to process various kinds of input signals, to compute the quantity of fuel to be supplied through the suction pipe 6 to the combustion chamber as determined by the execution of a predetermined program stored in advance in the ROM 82, and to control a drive signal to the injector 2. A RAM 83 of the controller 8 temporarily stores data as the microprocessor 81 executes computations. An output interface circuit 84 of the controller drives the injector 2.

The conventional engine control apparatus operates as follows. The quantity of fuel to be supplied to the engine is calculated by the controller 8 on the basis of a suction air quantity signal detected by the air flow sensor 3. At the same time, the rotational frequency of the engine is calculated on the basis of a rotation pulse frequency obtained from the igniter 9, so that a fuel quantity per engine revolution can be calculated. The controller 8 applies a required pulse width to the injector 2 in synchronism with an ignition pulse. The pulse width applied to the injector 2 is corrected so as to be increased or decreased in accordance with a temperature signal generated from the water temperature sensor 7 because it is necessary to set the required air/fuel ratio of the engine to the rich side when the temperature of the engine is low. Further, the air/fuel ratio is made richer upon detecting engine acceleration by monitoring the opening of the throttle valve 5.

In the conventional apparatus as described above the use of the hot-wire air-flow sensor 3 makes it unnecessary to include means for correcting atmospheric pressure. This is so because the sensor 3 can detect the quantity of suction air by weight. However, the sensor 3 is sensitive to the return blow of air produced by valve overlapping of the engine so that it may detect a signal representing a quantity of suction air in which the quantity of the return-blow air is also included. Accordingly, the output signal generated by the air-flow sensor 3 may express a quantity of suction air which is larger than the actual quantity of the suction air. Return blow is apt to occur during low-speed, full-power operation of the engine. For example, as illustrated in FIG. 2, although the true suction air is not sucked during time $t_R$, the measured suction air quantity has a wave form as shown in FIG. 2, which would seem to indicate that the suction air is increased by the return blow. As the result, the output of the air-flow sensor 3 expresses values, as shown in FIG. 3, considerably larger than the true values (shown by broken lines in the drawing), in the low-speed, full-power region. Although varying with the layout of the engine, the suction system, or the like, the error due to the return blow generally reaches a maximum of about 50% so that use of the sensor 3 as illustrated in FIG. 1 is not practical.

In order to compensate for such an error, there has been proposed a method in which values for the maximum quantity of suction air (including variations) to be sucked into the engine are stored in the ROM 82. As a result, as shown in FIG. 4, the output signal a generated from the air-flow sensor 3 is disregarded and clipped to a line of values as shown by "MAX" which are slightly larger (for example, 10%) than an average value b of the true suction air quantity. In this method, however, the clipping values represented by "MAX" imply that the maximum suction air quantity is set for engine operating conditions at sea level and at an ordinary temperature. Accordingly, the air/fuel ratio is greatly shifted to the rich side when the engine is operating at low atmospheric pressure at high altitudes or where the suction air temperature is high, increased fuel cost as well as the possibility of an accidental fire. Further, there is the corresponding problem that the air/fuel ratio is shifted to the lean side when the temperature of the suction air is low.

There also has been proposed a method in which wave forms affected by return blow are first determined and are then subjected to subtraction to thereby correct a detection error in a air-flow sensor 3 due to such return blow of suction air. However, the waveforms due to the return blow vary depending on both the rotational frequency of the engine and the opening of the throttle valve. Accordingly, it has been impossible to perform accurate correction.

Thus, with the conventional fuel injection control apparatus, there exists the problem that the hot-wire air-flow sensor 3 detects the suction air quantity as a value larger than the true value thereof because of the return blow of air produced during low-speed, full-power operation, so that the air/fuel ratio cannot be properly controlled over a certain running region.

SUMMARY OF THE INVENTION

An object of the present invention is to solve the above-discussed problems.

In particular, an object of the invention is to provide a fuel injection control apparatus for an internal combustion engine, arranged to obtain an appropriate air/fuel ratio by correcting the output of a hot-wire air-flow sensor in accordance with the rotational frequency of the engine, the opening of a throttle valve, and the opening of an air passage bypassing the throttle valve even when the engine is in a low-speed, full-power running region where return blow is generated.

The fuel injection control apparatus for an internal combustion engine according to this invention is arranged such that the opening of a suction air quantity regulating throttle valve is detected by a throttle valve opening detector. The opening of a valve in a passage bypassing the throttle valve is detected by a bypass opening detector. The rotational frequency of the engine is detected by a rotational frequency detector. The detection error of a hot-wire air-flow sensor due to the return blow of suction air in the engine is corrected on the basis of the respective detection outputs from those detectors.

BRIEF DESCRIPTION OF THE DRAWINGS

In the drawings, the same numeral refers to the same or like part.

DETAILED DESCRIPTION OF THE PREFERRED EMBODIMENTS

A controller of the fuel injection control apparatus according to this invention operates such that the opening of the throttle valve detected by a throttle valve opening detector is corrected on the basis of the bypass opening of the valve provided in the bypass passage, that a correction factor corresponding to both the corrected opening of the throttle valve and the rotational frequency of the engine detected by a rotational frequency detector is obtained from a preset map, and that an average of the output of the air-flow sensor is multiplied by the obtained correction factor to thereby correct the error of the air-flow sensor in the return-blow region.

Figure 1:
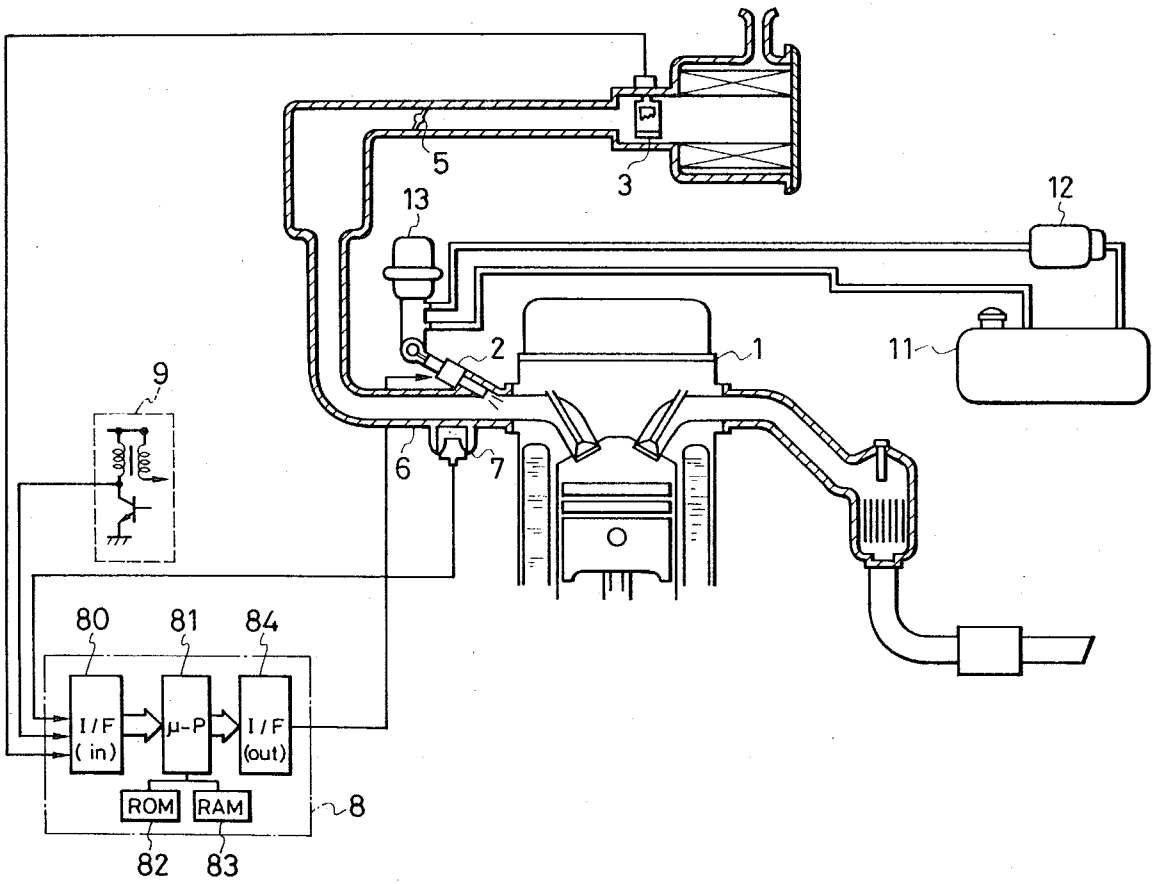
FIG. 1 PRIOR ART
FIG. 1 is a schematic view partly in section, of a conventional fuel injection control apparatus for an internal combustion engine.
Figure 2:
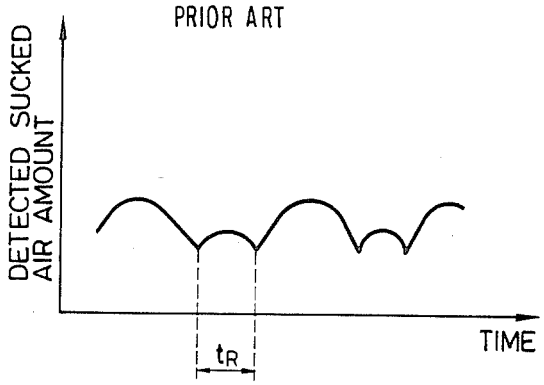
FIG. 2 PRIOR ART
FIG. 2 is a graph of the wave form of the air-flow sensor of FIG. 1.
Figure 5:
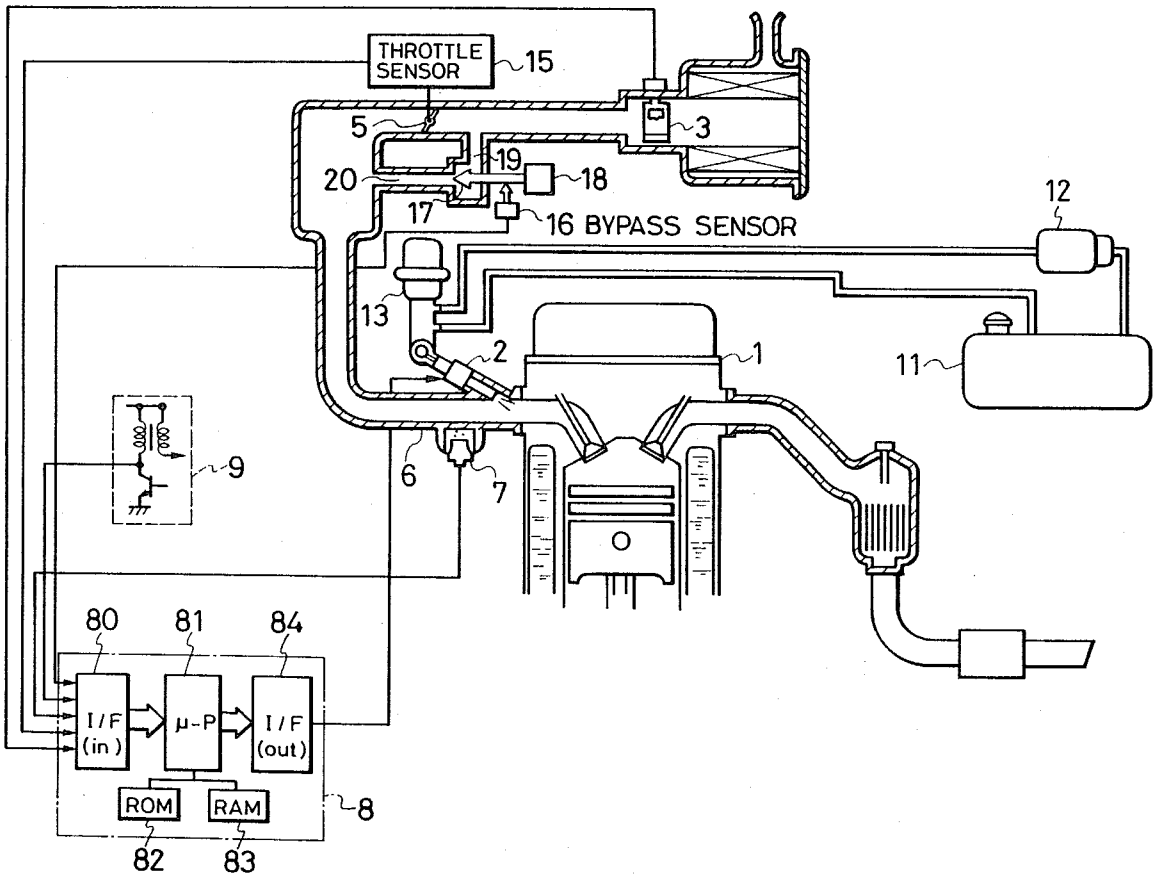
FIG. 5 is a schematic view partly in section, of a fuel injection control apparatus for an internal combustion engine in accordance with an embodiment of the present invention.
Figure 6:
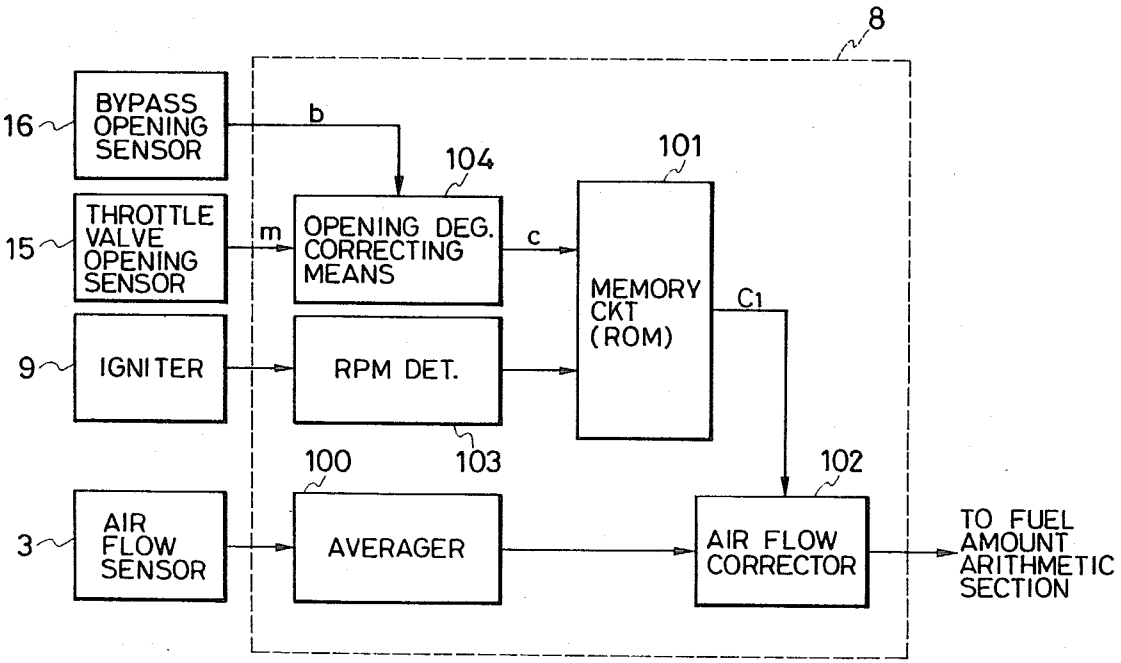
FIG. 6 is a diagram of a correcting circuit showing an embodiment of the present invention.

An embodiment of this invention will be described hereunder with reference to the drawings of FIGS. 5–8. A general drawing of the engine and fuel injection control system is shown in FIG. 5 and important parts of the fuel injection control system are also shown in FIG. 6. In FIG. 6, a throttle opening sensor 15 acts as a throttle valve opening rate detecting means and is constituted by a variable resistor, etc. It detects the opening of the throttle valve 5. A bypass valve 17 is provided between bypass passages 19 and 20 to supply fuel even when the throttle valve 5 is closed which occurs when the accelerator pedal is not depressed as is the case with a low load or in idling. A bypass opening sensor 18 acts as a bypass opening detecting means. An electric motor operates the bypass valve 17. The respective outputs of the two valve sensors 15 and 16 are supplied to the controller 8. Other like parts in each of FIGS. 1 and 5 are identified by the same reference numerals to avoid duplication of description.

The operation of the apparatus will now be described. The bypass passages 19 and 20 are provided to supply air to the engine by bypassing the throttle valve 5 in order to prevent lowering of the rotation rate of the engine when the throttle valve 5 is closed during idling. The air quantity passing through the bypass passages 19 and 20 is determined by to the load condition of the engine or the target rotational frequency for idling. The air quantity passing through the bypass passages 19 and 20 is variably controlled by the bypass valve 17 which is mechanically coupled to the motor 18 to thereby change its stroke. The bypass valve motor 18 is driven by a not-shown idling rotational frequency control means. In this embodiment, the fuel quantity is calculated by the controller 8 in the running region where no return blow of suction air occurs in a manner similar to that of the prior art apparatus, but the fuel quantity is corrected by the correcting circuit of FIG. 6 in the running region when return blow is generated.

In FIG. 6 a rotational frequency detecting means 103 detects the rotational rate of the engine from a signal, such as a signal of the igniter 9 or the like, having a frequency in proportion to the rotational frequency of the engine. An opening correcting means 104 corrects the opening signal m of the throttle valve opening sensor 15 by the opening signal b of the bypass opening sensor 16 to provide a signal c indicative of the total opening for the return blow. A memory circuit (ROM) 101 stores correction data in advance which corresponds to the output signal of the opening correcting means 104. An averaging means 100 averages the output signal of the air-flow sensor 3 over a short period of time. An air-flow correcting means 102 corrects the output signal of the averaging means 100 on the basis data of the storage circuit 101.

The opening correcting means 103 calculates an output $\theta_c$ which satisfies the following equation:

$$\theta_c = \theta_m + K \cdot \theta_b$$

where $\theta_c$ is the corrected opening, $\theta_m$ is the throttle valve opening, $\theta_b$ is the bypass opening, and K is the shape factor.

The above equation means that the corrected opening $\theta_c$ is a value obtained by addition of the bypass opening to the throttle valve opening $\theta_m$. The bypass opening $\theta_b$ is multiplied by a shape factor K, because the flow dividing ratio of the return blow of air varies depending on the shape of the bypass passage.

Figure 7:
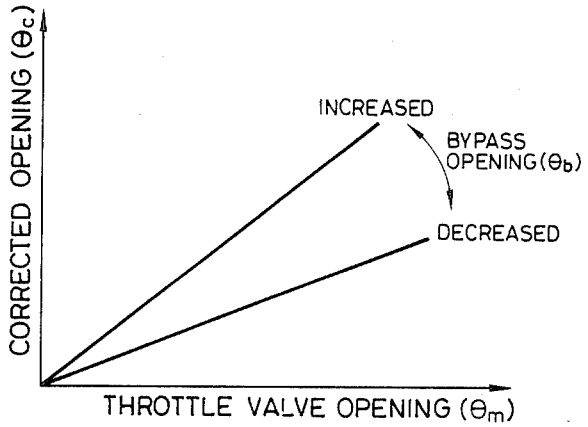
FIG. 7 is a characteristic graph of the corrected opening with respect to the bypass opening.

The corrected opening $\theta_c$ can be used as an exact parameter for controlling the return blow quantity of the suction air because its characteristic with respect to the throttle valve opening $\theta_m$ varies with the bypass opening $\theta_b$ as shown in FIG. 7.

Figure 8:
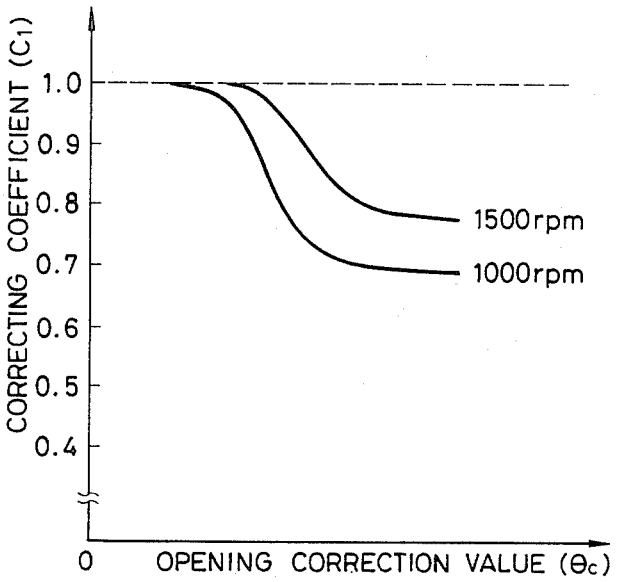
FIG. 8 is a characteristic graph of the correction factor of the correcting circuit of FIG. 6.

Various values of the correction factor $C_1$ are stored in the memory circuit 101 in advance as a map of the function shown in FIG. 8 corresponding to the respective outputs of the rotational frequency detecting means 103 and the opening correcting means 104. As a result, the proper value of the correction factor $C_1$ is multiplied by the average output of the air flow-sensor 3 in the air-flow correcting means 102 to thereby correct the error of the air-flow sensor 3 when return blow occurs.

Although the correcting circuit is shown in FIG. 6 as separate blocks, in fact, the correction control described above can be easily carried out by the use of the microprocessor 81, the ROM 82 and the RAM 83 provided in the controller 8.

The bypass opening sensor 16 need not be a position sensor for the valve 17. For example, in the case where a stepping motor is used as a drive means, the sensor 16 may be replaced by a virtual position stored in the RAM 83 provided in the controller 8.

The output of the air flow converting means 102 is preferably used as an air flow input to a circuit for correcting the return blow as disclosed in Japanese Patent Application Nos. 218138/85 and 238126/85, and their corresponding U.S. patent application Ser. Nos. 914,403 and 921,515, filed Oct. 2, 1986 and Oct. 22, 1986, respectively, incorporated herein by reference.

Figure 3:
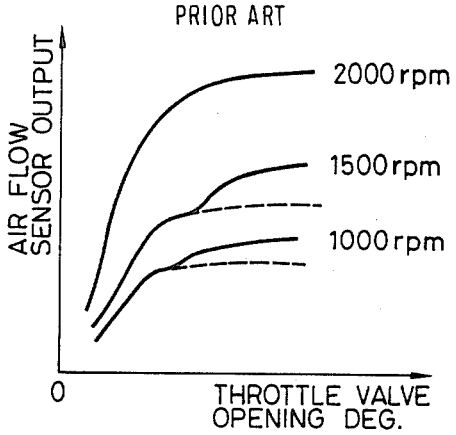
FIG. 3 PRIOR ART
FIG. 3 is a characteristic graph of the air-flow sensor of FIG. 1.
Figure 4:
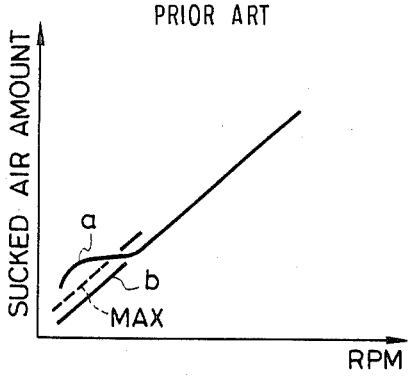
FIG. 4 PRIOR ART
FIG. 4 is a characteristic graph of the suction air quantity of FIG. 1.

As described above, according to the present invention, the output signal of the air-flow sensor in the return blow region of FIG. 3 can be easily reduced by the correction factor provided in advance so as to match the characteristics of the engine in accordance with the rotational frequency, the throttle valve opening and the bypass opening. There are additionally provided the opening sensors for detecting the opening of the throttle valve and for detecting the opening of the valve disposed in the air passage bypassing the throttle valve. In this way, the error in the output signal of the air-flow sensor can be corrected. Furthermore, the error can be appropriately corrected even in the case of low air density, as occurs in mountains. In short, the effect of the invention is that the air/fuel ratio does not vary widely to the rich side at high altitudes as occurs with conventional apparatus.

What is claimed is:

1. A fuel injector control apparatus, comprising:

an air-flow sensor for detecting a quantity of suction air supplied to an internal combustion engine;

an injector for injecting fuel into said engine;

a controller for controlling a quantity of said injected fuel responsive to an output of said air-flow sensor;

a throttle valve for regulating a quantity of said suction air;

throttle valve opening detecting means for detecting an opening of said throttle valve;

a bypass valve for said suction air bypassing said throttle valve;

bypass opening detecting means for detecting an opening of said bypass valve;

rotational frequency detecting means for detecting a rotational frequency of said engine; and first means for correcting said output of said air-flow sensor according to outputs of both said throttle valve opening detecting means and said bypass opening detecting means.

2. A fuel injector control circuit as recited in claim 1, wherein said air-flow sensor is a hot-wire air-flow sensor.

3. A fuel injector control circuit as recited in claim 1, wherein said first correcting means corrects said output of said throttle valve detecting means by said output of said bypass opening detecting means.

4. A fuel injector control circuit as recited in claim 1, wherein said first correcting means provides an output which is a linear function of said output of said throttle valve detecting means and said output of said bypass opening detecting means.

5. A fuel injector control circuit as recited in claim 2 further comprising second means responsive to an output of said first correcting means for correcting return blow through said air-flow sensor.

* * * * *